US005226973A

United States Patent [19]

Chapman et al.

[11] Patent Number: 5,226,973

[45] Date of Patent: Jul. 13, 1993

[54] HYDROCLEANING OF THE EXTERIOR SURFACE OF A PIPELINE TO REMOVE COATINGS

[75] Inventors: Gordon R. Chapman, Houston, Tex.; Charles M. Reid, Edmonton, Canada

[73] Assignee: CRC-Evans Rehabilitation Systems, Inc., Houston, Tex.

[21] Appl. No.: 790,572

[22] Filed: Nov. 8, 1991

Related U.S. Application Data

[63] Continuation-in-part of Ser. No. 486,093, Feb. 28, 1990, Pat. No. 5,074,323, which is a continuation-in-part of Ser. No. 197,142, May 23, 1988, Pat. No. 5,052,423, which is a continuation-in-part of Ser. No. 55,119, May 28, 1987, abandoned.

[51] Int. Cl.[5] ..... B08B 3/02; B08B 9/00

[52] U.S. Cl. ..... 134/34; 134/151; 134/152; 134/166 R; 134/166 C; 134/199

[58] Field of Search ..... 134/34, 181, 182, 199, 134/200, 122 R, 147, 151, 152, 166 C, 166 R

[56] References Cited

U.S. PATENT DOCUMENTS

| | | | |
|---|---|---|---|
| 1,899,379 | 2/1933 | Adams . | |
| 2,556,116 | 6/1951 | Smith | 263/2 |
| 2,651,312 | 9/1953 | McBeth | 134/122 |
| 2,685,293 | 8/1954 | Dauphinee et al. | 134/153 |
| 2,782,436 | 2/1957 | Tomer | 15/104.94 |
| 2,790,230 | 4/1957 | Sobek | 29/81 |
| 2,858,555 | 11/1958 | Medovick | 15/88 |
| 2,896,644 | 7/1959 | Emanuel | 134/99 |
| 2,900,992 | 8/1959 | Johnson | 134/122 |
| 3,023,756 | 3/1962 | Proctor | 134/57 |
| 3,033,215 | 5/1962 | Miller | 134/98 |
| 3,050,759 | 8/1962 | Betzel, Sr. | 15/104.04 |
| 3,086,537 | 4/1963 | Sieger | 134/61 |
| 3,101,730 | 8/1963 | Harris et al. | 134/167 |
| 3,117,401 | 1/1964 | Talley | 51/241 |
| 3,135,272 | 6/1964 | Brollo | 134/57 |
| 3,225,777 | 12/1965 | Shelton et al. | 134/141 |
| 3,226,277 | 12/1965 | Masuda et al. | 156/345 |
| 3,289,238 | 12/1966 | Sorenson et al. | 15/306 |
| 3,306,310 | 2/1967 | Grant | 134/122 |
| 3,407,099 | 10/1968 | Schell | 148/153 |

(List continued on next page.)

FOREIGN PATENT DOCUMENTS

| | | |
|---|---|---|
| 988403 | 5/1976 | Canada . |
| 1043056 | 11/1978 | Canada . |

(List continued on next page.)

OTHER PUBLICATIONS

M. Hashish, "Cutting With Abrasive Waterjets", *Mechanical Engineering*, pp. 60–69, Mar., 1984.

Canadian Ultra Pressure Services Inc. Bulletin, one page, published Nov., 1987.

Canadian Ultra Pressure Services Inc. Brochure, 28 pages, published Dec., 1987.

NLB Corp. Brochure, pp. 8, 9, and 13.

ADMAC Brochure, "Model 5035 Jetlance TM MKII System", 4 pages.

ADMAC Brochure drawing, single page.

Butterworth Jetting Systems Inc. Brochure, "20,000 PSI Waterjetting", 4 pages, published Sep., 1986.

*Primary Examiner*—Theodore Morris

*Assistant Examiner*—Zeinab El-Arini

*Attorney, Agent, or Firm*—Richards, Medlock & Andrews

[57] ABSTRACT

A plurality of liquid jet nozzles are positioned in spaced apart relation to each other about a portion of the exterior surface of a pipe to be cleaned. High pressure liquid is supplied to the nozzles to cause liquid jets to be emitted, with the liquid jets being directed toward the exterior surface of the pipe. Each nozzle can be rotated about an axis which is at least substantially normal to the exterior surface of the pipe, while the nozzles are being moved longitudinally relative to the pipe. The liquid jets from the nozzles simultaneously impinge on the exterior surface of the pipe along prescribed paths located in an annular region extending around the circumferential extent of the pipe. Each of the prescribed paths is in the form of continuous convolutions, and the prescribed paths together extend around the full circumferential extent of the pipe while the annular region travels longitudinally relative to the pipe, whereby cleaning of the exterior surface of the pipe can be affected by a single longitudinal pass of the annular region.

24 Claims, 8 Drawing Sheets

U.S. PATENT DOCUMENTS

| | | | |
|---|---|---|---|
| 3,432,872 | 3/1969 | Kirschke | 15/104.12 |
| 3,468,362 | 9/1969 | Burkhardt et al. | 164/89 |
| 3,698,029 | 10/1972 | Pulliam | 15/21 D |
| 3,760,824 | 9/1973 | Edwards et al. | 134/144 |
| 3,773,059 | 11/1973 | Arneson | 134/123 |
| 3,902,513 | 9/1975 | Franz | 134/151 |
| 3,933,519 | 1/1976 | Koch et al. | 134/34 |
| 3,942,565 | 3/1976 | Ratelle et al. | 144/311 |
| 3,994,766 | 11/1976 | Dedels | 156/392 |
| 4,013,518 | 3/1977 | Miko | 202/241 |
| 4,125,119 | 11/1978 | Haas | 134/100 |
| 4,146,406 | 3/1979 | Sampsell | 134/167 R |
| 4,161,956 | 7/1979 | Hadgkiss | 134/167 C |
| 4,185,359 | 1/1980 | Niccols | 17/51 |
| 4,205,694 | 6/1980 | Thompson et al. | 134/181 |
| 4,219,155 | 8/1980 | Goerss | 239/124 |
| 4,225,362 | 9/1980 | Sentell | 134/24 |
| 4,231,239 | 11/1980 | Lazaroff | 68/205 R |
| 4,237,913 | 12/1980 | Massberg | 134/167 C |
| 4,244,524 | 1/1981 | Wellings | 239/227 |
| 4,337,784 | 7/1982 | Goerss | 134/34 |
| 4,376,443 | 3/1983 | Mondy, Jr. | 134/168 R |
| 4,443,271 | 4/1984 | Goerss | 134/34 |
| 4,445,451 | 5/1984 | van den Broek | 114/222 |
| 4,460,005 | 7/1984 | Rodger | 134/104 |
| 4,509,544 | 4/1985 | Mains, Jr. | 134/144 |
| 4,552,594 | 11/1985 | van Voskuilen et al. | 134/34 |
| 4,569,159 | 2/1986 | Wern et al. | 51/410 |
| 4,603,516 | 8/1986 | Hoffman | 51/425 |
| 4,677,998 | 7/1987 | van Voskuilen et al. | 134/181 |
| 4,718,439 | 1/1988 | Gorra et al. | 134/57 R |
| 4,788,993 | 12/1988 | Beer et al. | 134/123 |
| 4,809,720 | 3/1989 | Heraty | 134/45 |
| 4,811,902 | 3/1989 | Nagata | 239/240 |
| 4,953,496 | 9/1990 | Taylor et al. | 118/72 |
| 5,052,423 | 10/1991 | Chapman et al. | 134/174 |
| 5,056,271 | 10/1991 | Rose | 51/319 |
| 5,074,323 | 10/1991 | Chapman et al. | 134/181 |
| 5,092,357 | 3/1992 | Chapman et al. | 134/181 |

FOREIGN PATENT DOCUMENTS

| | | |
|---|---|---|
| 1080918 | 7/1980 | Canada . |
| 1131418 | 9/1982 | Canada . |
| 1211352 | 9/1986 | Canada . |
| 0105545 | 4/1984 | European Pat. Off. . |
| 0214841 | 3/1987 | European Pat. Off. . |
| 54-50158 | 4/1979 | Japan . |
| 59-232770 | 12/1984 | Japan . |
| 60-121286 | 6/1985 | Japan . |
| 1276379 | 12/1986 | U.S.S.R. . |
| 1516903 | 7/1978 | United Kingdom . |
| 2018626 | 10/1979 | United Kingdom . |
| 8502211 | 5/1985 | World Int. Prop. O. . |

HYDROCLEANING OF THE EXTERIOR SURFACE OF A PIPELINE TO REMOVE COATINGS

CROSS REFERENCE TO RELATED APPLICATIONS

This is a continuation of our copending application Ser. No. 486,093, filed Feb. 28, 1990, now U.S. Pat. No. 5,074,323 which is a continuation-in-part of our copending application Ser. No. 197,142 filed May 23, 1988, now U.S. Pat. No. 5,052,423 which, in turn, is a continuation-in-part of our application Ser. No. 055,119 filed May 28, 1987 (now abandoned), the disclosures of which applications are incorporated herein by reference thereto.

Reference may also be had to our European patent application No. 0343878 published Nov. 29th, 1989 which application corresponds to the above-noted application Ser. No. 197,142.

BACKGROUND & SUMMARY OF THE INVENTION

The present invention relates generally to improvements in apparatus for effecting hydrocleaning of the exterior surfaces of pipelines and the like, including pipeline sections, so as to remove coatings and miscellaneous contaminants from the pipeline exterior surface.

As described in the above-noted patent applications, oil and gas transmission pipelines of large diameter (e.g. 12 inches–60 inches) are usually coated and then buried before being used for transportation of fluid. The coatings serve to reduce corrosion caused by the various soils and weathering conditions encountered. Various forms of coating materials have been used over the years. Coal tar products were and are well known as coating materials and, more recently, polyethylene tape layered coatings have been used. However, over the years, these coatings have deteriorated in many instances and several pipeline operators have experienced failures in old coatings. These failures usually involve debonding between parts of the coating and the pipe. Despite the use of cathodic protection, the debonded areas are subject to pitting corrosion and to stress corrosion cracking and in very severe cases pipe failures have occurred under pressure. As a result, many operators have initiated coating rehabilitation projects.

The preferred form of apparatus described in the above-noted earlier patent applications incorporated a main frame adapted to at least partially surround a portion of a pipeline and suitable means for advancing the frame relative to the pipeline in the lengthwise direction when in use. A multiplicity of liquid jetting modules were mounted to the frame in circumferentially spaced relation to each other so as to substantially surround the pipeline when in use. Each such module included a rotary swing arm nozzle thereon having a rotation axis, in use, disposed substantially normal to the pipeline surface for directing liquid jets onto the pipeline surface in a series of closely spaced overlapping convolutions during movement of the frame relative to and lengthwise of the pipeline. Suitable guides, e.g. guide wheels located on each module, made contact with the pipeline surface during movement relative thereto. Suitable suspension linkages connected each module to the frame and a biasing arrangement was provided for urging the respective modules toward the pipeline surface while permitting independent movement of the modules relative to the frame and to one another radially inwardly and outwardly relative to the pipeline as the respective guides contacted and followed the pipeline surface when in use.

The frame configuration for the above-noted hydrocleaner. typically included an upper section shaped to surround an upper portion of the pipeline when in use and a pair of lower frame sections pivotally mounted to lower opposed extremities of the upper section for movement between open and closed positions. When the lower sections were in the open position the frame could be lowered downwardly onto the pipeline and the lower sections thereafter closed around the lower portion of the pipeline so that the frame at least partially surrounded the pipeline. Certain of the liquid jetting modules were mounted to the upper frame section while others were mounted to the respective pivotal frame sections. Drive wheels were mounted to the upper frame section for engaging the pipeline surface and advancing the frame relative to the pipeline while the lower frame sections were provided with idler wheels and/or further drive wheels which acted generally in opposition to the drive wheels on the upper frame section thereby to help provide the required tractive forces. An actuator system for pivoting the lower frame sections was provided with suitable biasing means thereby to ensure that the lower idler and/or drive wheels were kept in close pressurized engagement with the pipeline surface so as to provide the required tractive force.

Although the above-described arrangement was found to work quite well, problems were noticed in respect of certain major pipeline variations and deviations from the normal. These deviations involved "out of roundness" of the pipe (usually caused by bending of the pipe); excessively thick coal tar coatings (possibly up to three inches in some sections) along the line and, in some areas, varying thicknesses of coatings around the pipe's circumference especially toward the bottom and, finally, wrinkles in the pipeline surface particularly in the region of bends.

When the above-described hydrocleaning apparatus was used to treat pipeline portions having any or all of the above conditions, certain problems became evident. Many of the problems arose because the above-referred to pivotally mounted lower frame sections would move inwardly and outwardly relative to the center of the pipeline as the wheels thereon followed the pipeline surface. The drive wheels on the upper frame section would of course be in firm contact with upper surface portions of the pipeline at all times as well. Hence, when irregularities of the type noted above were encountered, the lower frame sections would pivot slightly relative to the upper frame section thus varying the relative orientations between the suspension linkages for the liquid jetting modules mounted on the upper frame section and the suspension linkages for those mounted on the lower frame sections. This was found to give rise to losses in cleaning efficiencies for several reasons. Firstly, it will be realized, particularly after a review of the disclosures of the above-noted copending applications, that for maximum efficiency the rotation axis for each of the rotary swing arm nozzle assemblies should pass directly through the pipeline axis. However, once the relative positions of the module suspension linkages had been altered by virtue of the pipeline irregularities noted above, the rotation axes for certain of the swing arms could no longer pass through the pipeline axis. The distances the water jets had to travel from the respective nozzles of the swing arm assemblies to the pipeline surface (referred to as the side standoff distances in the above-noted patent applications) were no longer equal to each other thus causing a loss in cleaning efficiency. Furthermore, although the diameters of the rotary swing arm nozzle assemblies were originally chosen such that the cleaning paths swept out by same would overlap at least slightly on the pipeline surface under normal conditions, the irregular conditions noted above and the resulting changes in the relative orientations around the pipeline surface could in certain cases cause this overlap to be lost with the result being that longitudinally extending streaks of unremoved coating were left on the pipe. While an increase in swing arm length might have been of assistance in some cases, it had to be kept in mind that in many cases, for example a machine having five swing arm assemblies, that the amount of permissible increase in swing arm length was very limited due to the possibility of one swing arm contacting an adjacent one during operation.

In order to alleviate the problem noted above, the present invention in one aspect provides a modified frame arrangement wherein the above-noted lower frame sections each include a pair of independently pivotable frame portions. A first one of each of these frame portions is pivotable from the open position into a predetermined or set closed position (as by virtue of suitable stops being provided on the cooperating frame portions) relative to the upper frame section. The second one of each of the frame portions has wheels (idler and/or drive wheels) mounted thereon for engaging the pipeline surface at locations generally opposed to the locations where the drive wheels on the upper frame section engage the pipeline surface thereby, as before, to provide the desired degree of tractive force.

Suitable actuators, as before, are provided for moving the pairs of pivotable frame portions between the open and closed positions. These actuators are arranged to resiliently bias at least the above-noted second ones of the frame portions toward the closed position such that the wheels thereon engage the pipeline surface in pressurized relation thereby to follow irregularities in the pipeline surface and to assist the drive wheels in providing the required tractive force.

The liquid jetting modules are mounted to the frame via their suspension linkages with certain of these modules being mounted to the upper frame section as before. However, the remaining liquid jetting modules are mounted via their respective suspension linkages only to the above-noted first ones of the pivotable frame portions so that when the latter are in their predetermined closed positions (as defined by their respective stops) the positions which the suspension linkages for the liquid jetting modules occupy relative to one another around the pipeline surface are essentially independent of the variable positions of the above-noted second ones of the frame portions as the wheels thereon follow irregularities and/or out of round conditions in the pipeline surface.

By virtue of the above arrangement, the previously noted problems of longitudinal streaking and loss in cleaning efficiencies due to "side stand off" variations are greatly diminished.

Another problem associated with the earlier form of hydrocleaning apparatus described in the above-noted patent applications concerns the mounting arrangement for the several liquid jetting modules. It was previously noted that suspension linkages were used to connect each module to the frame and to permit independent movement of the modules relative to the frame and to one another radially inwardly and outwardly relative to the pipeline when in use. Guide wheels were located on both the forward and rearward portions of each module for contacting the pipeline surface during relative movement therealong. The linkage arrangements as described in the above patent applications are parallel arm linkages and as the modules were moved inwardly and outwardly they were retained in parallel positions relative to the pipeline axis. This arrangement was found to work very well in most situations but in cases where relatively thick pipeline coatings were encountered, it was found that with the forward guide wheel riding up on the relatively thick coating, the minimum standoff distance between the pipeline surface and the rotary swing arm nozzle was excessive at the rear portion of the nozzle pass. While the standoff distance at the forward portion of the pass was acceptable as this was being governed by the front guide wheel, a system had to be found to move the nozzles' rearward pass inwardly towards the pipeline surface so as to permit the normal minimum standoff distance of, for example, one-half inch, to be obtained for the rear pass of each swing arm revolution.

In order to alleviate the above problem the invention in a further aspect provides for a transverse pivot arrangement which secures each module to its associated suspension linkage so as to permit pitching motions of the modules to take place as the guides thereon follow irregularities in the pipeline surface. As a result of this pitching motion, a desired minimum standoff distance between the rotary swing arm nozzles and the pipeline surface can be maintained at both the rearward and forward extremities of the path of motion of the rotary swing arms thus helping to ensure good cleaning efficiencies even in the case of relatively thick coatings.

The transverse pivot described above typically defines an axis passing through the rotation axis of the associated swing arm nozzle assembly. A further desirable feature includes the provision of an adjustment mechanism associated with the pivot to provide for adjustment of the orientation of the nozzle rotation axis in a plane passing through the pivot axis and transverse to the pipeline axis thereby to enable the previously noted side standoff distances to be adjusted an equalized.

Notwithstanding what has been stated above regarding the desirability of providing the transverse pivot for securing each module to its associated linkages, there are situations which may be encountered wherein no pitching or rocking of the modules is desired. Accordingly, as a further feature, means are provided for locking each module relative to a portion of its suspension linkage such that, in use, only the forward guide contacts the pipeline surface with the module moving radially inwardly and outwardly in generally parallel relation to the pipeline surface as the forward guide encounters pipeline surface irregularities, including various coating thicknesses and the like.

In the hydrocleaning apparatus as described in the aforementioned copending applications, the liquid jetting module are positioned on the frame between fore and aft sets of drive wheels. In the course of a hydrocleaning operation it will be appreciated that the high velocity liquid jets are cutting through the coatings with the result being that particles of coatings such as particles of coal tar, large and small pieces of plastic tape and adhesive released from the pipeline surface all tend to become caught under the loaded rear drive wheels with the result being that some of these materials may be pressed back onto the pipeline surface. This phenomenon is called "tabbing" and this material must be scraped off the surface by hand. Also it was noted that strips of the plastic tape tend to get caught in the drive chains and this eventually builds up sufficiently to break the chain.

In order to alleviate the above-noted problem, the present invention in a further aspect provides for all of the drive wheels to be located on the frame such as to be disposed forwardly of the modules and hence forwardly of the region of contact of the liquid jets with the pipeline surface. In this way, the pipeline surface materials (e.g. old coating materials) dislodged by these jets do not interfere with the action of the drive wheels thus avoiding tabbing and fouling of the pipeline surface. Hence, in a preferred embodiment of the invention, the liquid jetting modules and their associated suspension linkages project or extend rearwardly of the hydrocleaning frame assembly in what might be termed a cantilever fashion.

For all forms of hydrocleaning machines some form of protective shrouding is needed, firstly, to prevent injury to personnel due to the ultra high water pressures and rotating equipment involved, and secondly, in order to satisfy environmental concerns. In the operation of the hydrocleaning equipment a mist is created containing liquid and small particles of debris and this must be contained well enough so as not to allow more than perhaps 5% of it or so to escape to the surroundings. The shrouding must be capable of accomplishing the above objectives and, moreover, it must enable the water jetting modules to move radially inwardly and outwardly during operation without possibility of interference between adjacent shrouds.

Accordingly, in a further aspect of the invention, each of the water jetting modules includes a shroud, with the shrouds of adjacent modules being in overlapping relation to one another such that the shrouds together define an annular array surrounding and confining the rotary swing arm nozzles all around the pipeline when in use so as to substantially prevent random escape of liquid and removed debris. The overlapping relationship between the adjacent shrouds allows for substantial radial motions of the liquid jetting modules and their shrouds relative to one another while avoiding both interference between as well as the formation of gaps between the shrouds through which liquid and debris might escape.

In a preferred form of the invention resilient sealing flaps extend between adjacent shrouds in the overlap regions to further inhibit escape of materials from between the shrouds. Certain of the lowermost shrouds are provided with recess means for receiving liquid and debris with an opening being provided for draining liquid and debris from the recess. The shrouds typically include side wall portions which extend toward the pipeline surface into closely spaced proximity thereto to avoid escape of liquid and debris.

It was previously noted that suspension linkages are provided for connecting the modules to the frame with suitable actuators being provided for positively moving these modules toward or away from the pipeline surface. A further improvement concerns the provision of time delays associated with certain of the actuators and arranged to permit the radial movements of the modules to take place in a predetermined sequence which is so selected as to avoid interference between adjacent shrouds during this radial motion either toward or away from the pipeline surface.

In the period when the older pipelines were being constructed, the most common type of pipe coating utilized was coal tar with an outer wrap. The most common outer wrap at the time was asbestos felt. Since 1972, asbestos has been recognized as a hazardous material. Any time this material is present in a working environment, extreme care must be taken to prevent the asbestos from becoming airborne and inhaled by working personnel. Both EPA and OSHA have promulgated regulations concerning such environments.

It is generally accepted that there is no danger to the personnel or environment during application of such an outer wrap because the asbestos is non-friable and encapsulated in tar. However, during the removal process, the condition of the coating is much different. With age, the coal tar and outer wrap become brittle, forming a hard, easily broken coating. In this condition, the asbestos is friable and any mechanical action to the asbestos results in its becoming airborne. Prior methods of removing such coatings included wire brushes, knives, hammers and scrapers. These mechanical techniques each created dust upon removal of the coating, thus rendering these techniques unacceptable under today's safety considerations when there is an asbestos content in the coal tar coating.

Pipeline owning companies are currently confronted with many thousands of miles of pipe coated with asbestos materials without an adequate removal method in existence. Without a safe removal technique, the companies must either lower line pressures, shut down the line or replace it. Development of an approved and safe cleaning and removal technology which complies with environmental and personnel safety standards is therefore greatly needed.

Further features and advantages of the invention will become readily apparent from the following description of a preferred embodiment of same.

BRIEF DESCRIPTION OF THE VIEWS OF DRAWINGS

DETAILED DESCRIPTION OF PREFERRED EMBODIMENT

Figure 1:
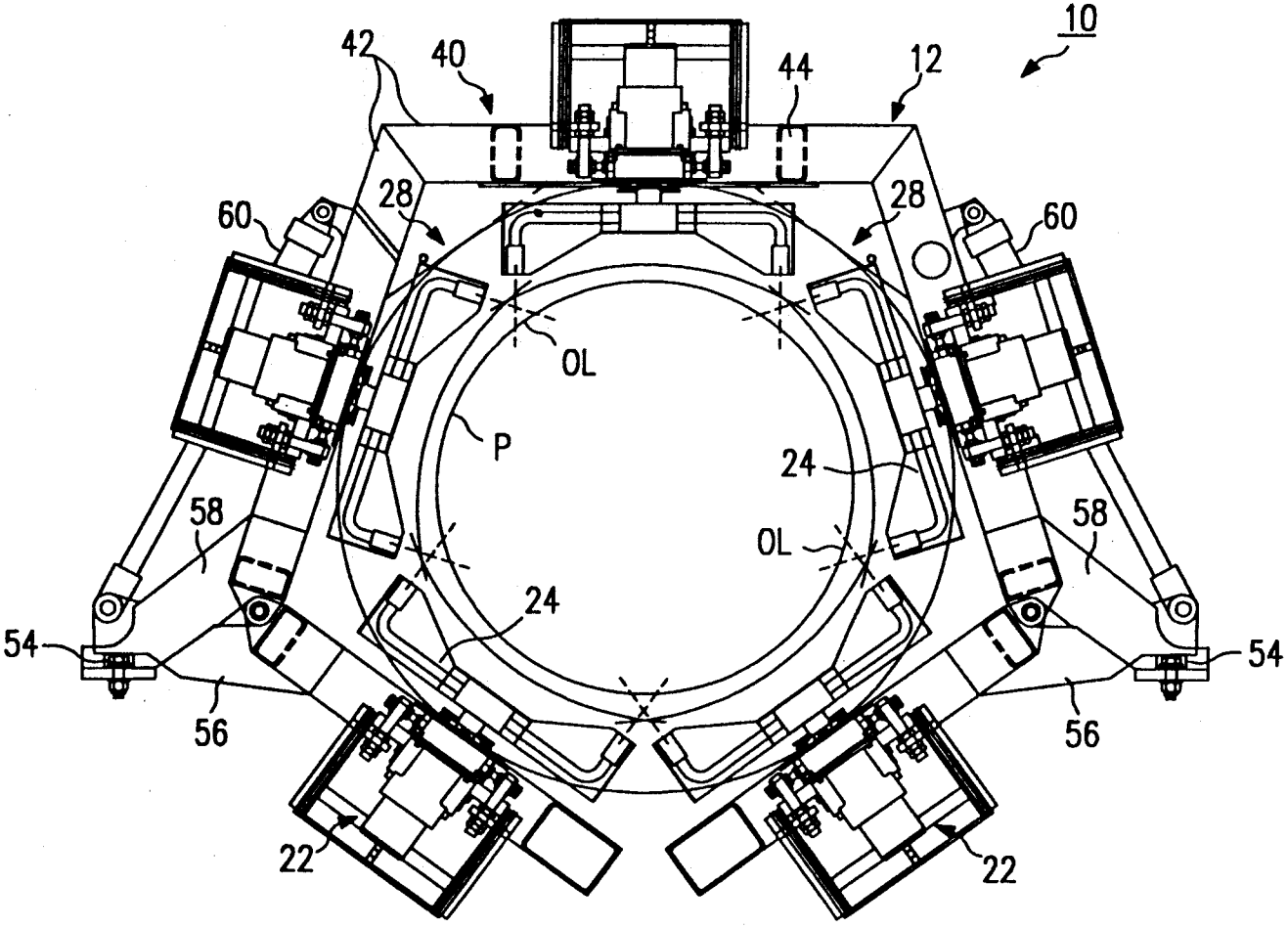
FIG. 1 is a cross-section view of a hydrocleaning apparatus according to the invention; certain details, such as the drive assemblies, having been omitted.

The basic principles relating to hydrocleaning of a pipeline surface are set out in detail in our above-noted co-pending applications and need not be repeated here. The above co-pending applications also describe all the various pieces of support equipment required including the side boom tractor, pipe cradle and bridle assembly, water and hydraulic pumps, prime mover and water supply tanks etc.

Referring now to the drawings, the hydrocleaning apparatus 10 includes a frame 12 adapted to at least partially surround a portion of a pipeline P when in use. The frame 12 is supported and driven along the pipeline P by way of spaced apart fore and aft drive assemblies 14, 16 (FIG. 2 and 3) including pairs of drive wheels 18, 20 which engage the pipeline surface to propel the entire apparatus forwardly.

A plurality of liquid jetting modules 22 are mounted to the frame 12 in circumferentially spaced relation so as to substantially surround the pipeline when in use. Each module 22 has a rotary swing arm nozzle 24 thereon, each being rotated about an axis (which in use is substantially normal to the pipeline surface) for directing liquid jets on to the pipeline surface in a series of closely spaced overlapping convolutions during forward advance of the frame 12 along the pipeline P. The cleaning paths thus defined by the several swing arm nozzles 24 ideally overlap somewhat at their marginal edges, as indicated by the letters OL in FIG. 1, thus helping to ensure that no unclean longitudinal streaks are left on the pipeline. The jetting modules 22 are mounted to the frame 12 by respective suspension linkages 26 which allow radial motion of the modules inwardly and outwardly relative to the pipeline axis.

Each of the modules is provided with a shroud 28 (shown in section in FIG. 1 for purposes of clarity), these shrouds being disposed in an overlapping configuration all around the pipeline and the swing arm nozzles 24 to reduce escape of contaminants into the environment and for safety reasons, all as will be described in further detail hereafter.

Returning now to the frame 12, it will be seen that it is made up from sturdy tubular members welded and connected together to provide the necessary strength and rigidity. Frame 12 includes an upper frame section 40 of a generally inverted U-shape, as seen end-on, so as to surround the upper portion of the pipeline P when in use, section 40 comprising three sub-sections 42 rigidly connected together by welds and including longitudinal frame elements 44 rigidly securing fore and aft frame portions together. Frame 12 also includes a pair of lower opposed frame sections 46 pivotally mounted via hinges 48 to lower opposed extremities of the upper section 40 for movement between open and closed positions. When these lower sections 46 are in the open position, the entire hydrocleaner can be lowered downwardly onto a pipeline (as described in the above-noted patent applications) and the lower frame section 46 then closed around a lower portion of the pipeline as shown in FIG. 1.

The lower frame sections 46 each comprise a pair of independently pivotable frame portions 50, 52 (FIG. 3) each of rigid triangular outline configuration. The first frame portions 50 are pivotable from the open position into a predetermined or fixed closed position relative to the upper frame section 40 about their hinges 48. The predetermined closed position is shown in FIG. 1, such closed position being provided by adjustable hinge stops 54 co-acting between a rigid extension arm 56 fixed to each frame portion 50 and a bracket 58 fixed to the lower portions of the upper frame section 40. The adjustable stop 54 may comprise a threaded stud and lock nut configuration well known as such.

The first frame portions 50 serve to each mount a respective water jetting module 22 via a respective parallel arm suspension linkage 26 to be described in detail later on. When frame portions 50 are in the predetermined closed positions against stops 54, the rotation axes of the respective swing arm nozzles 24 (including those mounted to the upper frame section) all pass substantially through the axis of the pipeline and this condition is maintained regardless of out of round pipeline and other irregularities as noted previously. Hence, a shorter swing arm length can be used while still providing the desired amount of overlap OL of the cleaning paths provided. For example it was found that five swing arms could be used around pipe as small as 16 inches OD without the risk of the swing arms touching each other when set at normal stand-off distances. Streaking problems and side stand-off distance variations were greatly reduced.

The second frame portions 52 serve to mount respective idler wheels 58 (FIG. 2) which engage the pipeline surface at locations generally opposed to the locations where the drive wheels 18, 20 (which are mounted to the upper frame section) engage the pipeline. The idler wheels may, if desired, be replaced with further sets of drive wheels and associated drive assemblies to provide extra tractive force. Multi-hole mounting plates 60 provide the necessary radial adjustability to accommodate a wide variety of pipeline diameters.

Figure 2:
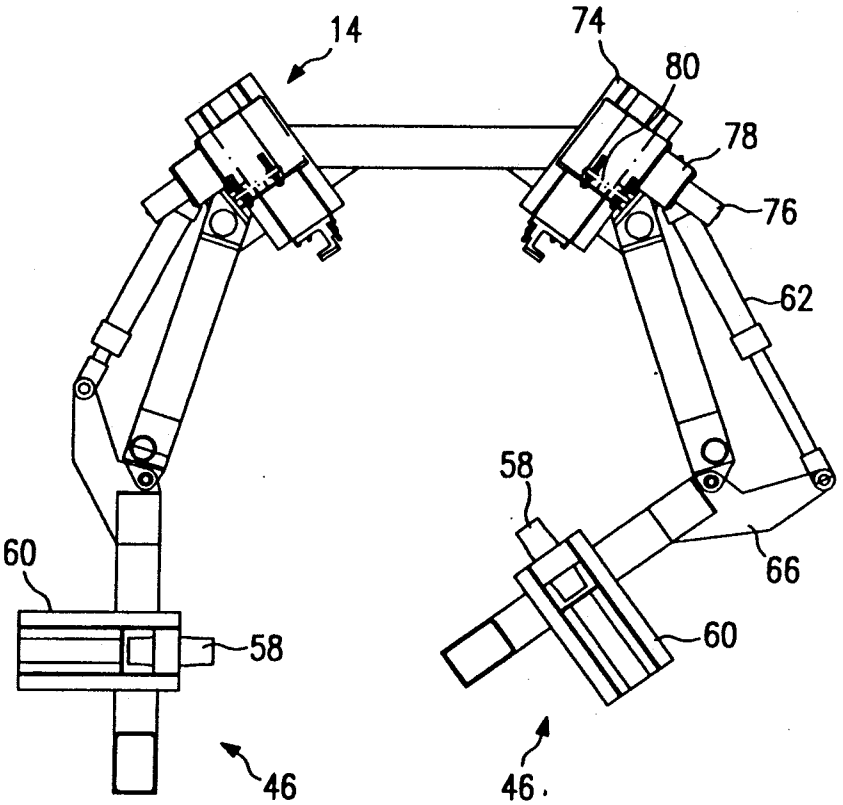
FIG. 2 is a front end elevation view of the frame assembly and drive, the liquid jetting modules and their suspension linkages having been omitted.
Figure 3:
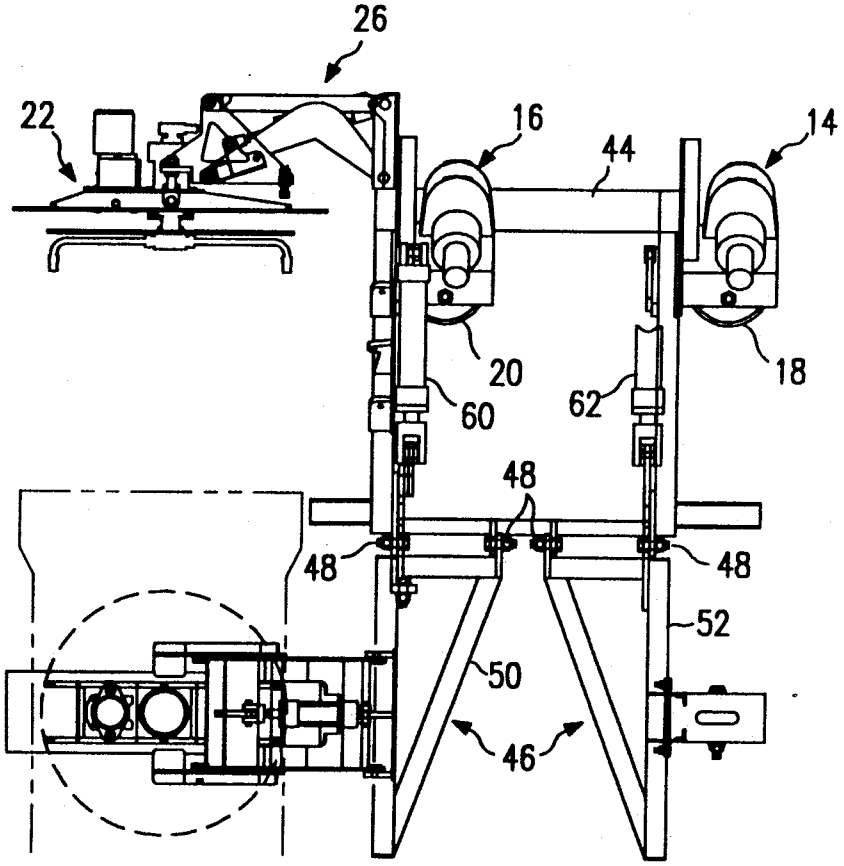
FIG. 3 is a side elevation view of the hydrocleaning apparatus, several of the liquid jetting modules and their suspension linkages and shrouds having been omitted.

The frame portions 50, 52 are each provided with their own hydraulic actuators 60, 62 respectively, each of which acts between a respective lug fixed to the upper frame section 40 and an associated extension arm fixed to the frame portion 50, 52. Actuators 60 for the first frame portions 50 (to which the lower modules 22 are mounted) are secured to the above-noted extension arms 56 while actuators 62 for the second frame portions 52 (to which the idler wheels 58 are mounted) are secured to similar extension arms 66 (FIG. 2).

All of the actuators are supplied via a common hydraulic supply and control circuit 68 (FIG. 14) of a conventional nature having a pre-charged pressure accumulator 70 therein. Hence, when the lower frame sections are closed, the first frame portions 50 are brought into the pre-set positions against the stops 54 while the second frame portions 52 are resiliently biased inwardly as a result of the action of the accumulator to bring the idler wheels into tight engagement with the pipeline surface thereby to enhance the tractive force the drive wheels 18, 20 are capable of supplying. As the idler wheels 58 encounter pipeline irregularities of the type noted previously, the second frame portions 52 are free to pivot inwardly or outwardly. However, since the first frame portions 50 remain in their fixed positions against the steps 54, the relative orientations of the suspension linkages 26 for the water jetting modules are in no way affected by these motions of the frame portions 52 as the idler wheels follow irregularities in the pipeline surface.

The above-noted front and rear drive assemblies 14, 16 need not be described in detail. They are mounted to the upper frame section 40 by way of multi-hole brackets 74 permitting substantial radial adjustment to accommodate a wide variety of pipe sizes as noted in our prior patent applications. Each drive assembly includes a hydraulic motor 76 which is connected to a reduction gear box 78, the output of the latter being conveyed to the associated drive wheel 18, 20 via a chain and sprocket drive 80. The hydraulic supply and control system for the wheel drive motors 76 is shown in FIG. 14 and includes main control valve 82 with on-off, reverse and forward functions and the usual over-pressure relief and safety valves, none of which need be described in detail.

Referring to FIGS. 4–7 one of the modules 22 is shown, partly in cross-section. Reference may be had to our above-noted patent applications for details of the structure. The rotary swing arm assembly 24 is mounted to the output shaft 84 of a commercially available rotary swivel assembly 90 which is mounted to the module frame 91 and connected to the high pressure source (e.g. 20,000 to 35,000 psi) by supply lines (not shown). The swivel is driven in rotation at a suitable speed (e.g. 1000 RPM depending on rate of advance and other factors as outlined in our prior patent applications) by way of hydraulic motor 92 and intermediate gear drive box 94. The high pressure water passes axially through the shaft 84 and thence along the swing arms 96 and through the jet nozzles 98 at the tips of the arms, all as described in our earlier patent applications.

The previously noted suspension linkage 26 for mounting each module 22 to the frame 12 of the machine will be described in further detail. Essentially, the linkage ensures that the module can move in and out in a radial direction while the swing arm axis is maintained in substantial alignment with the pipeline axis. Thus each linkage 26 comprises a parallel arm linkage including upper and lower rigid control arms 100, 102. The forward ends of arms 100, 102 are pivotally mounted at spaced pivot points 104, 106 to a multi-hole adjustment bracket 108 which in turn is secured to the machine frame (the multiple holes accommodate adjustments in respect of a wide variety of pipe sizes). The trailing ends of arms 100, 102 are pivotally attached at spaced pivot points 108, 110 to an end link 112, the latter having a somewhat triangular configuration as seen side-on. A hydraulic cylinder 114 extends from a lug on adjustment bracket 108 to a lug 116 near the trailing end of the lower control arm 102. As cylinder 114 is advanced and retracted the parallel arm linkage is moved radially inwardly and outwardly relative to the pipeline surface along with the module 22 fixed thereto.

Figure 14:
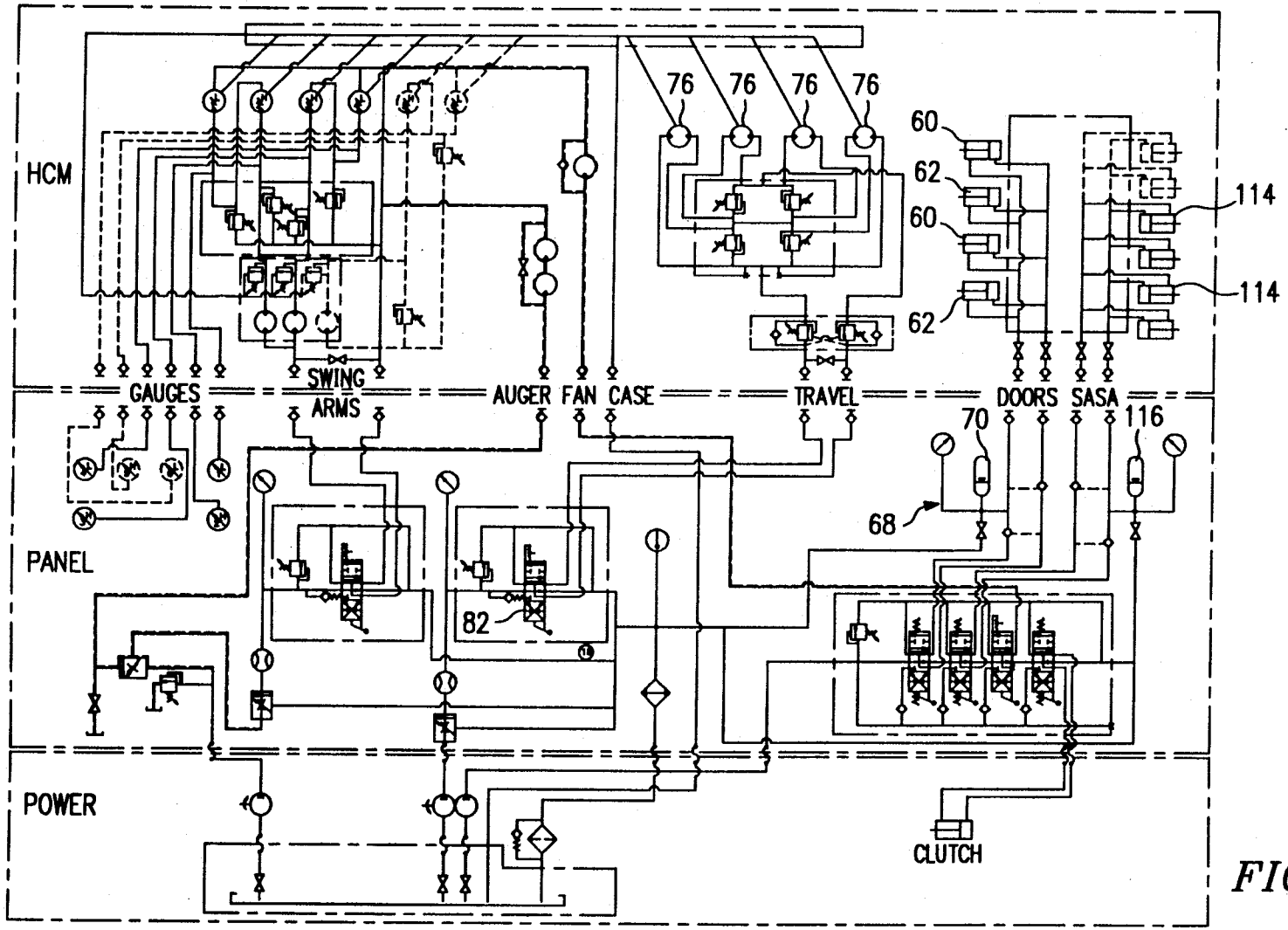
FIG. 14 is a schematic of the hydraulic system.

The control valves and hydraulic circuit for all the hydraulic cylinders 114 are shown in FIG. 14. The hydraulic circuit includes a pressurized accumulator 116 which acts to cause each cylinder to bias its associated linkage and attached module toward the pipeline surface when the equipment is in use.

The above-noted end link 112 of the suspension linkage 26 is connected to the module 22 by a pivot assembly 120 defining a transverse pivot axis passing through the rotation axis of the swing arm assembly 24. Pivot assembly 120 includes a laterally spaced pair of eye bolts 122, each mounted in a respective flange 124 fixed to the end link 112. Transverse studs 126 pass through the "eyes" of these eye bolts 122 and into the frame 91 of the module 22. By adjusting the adjustment nuts 128 on the eye bolts, the swing arm rotation axis orientation can be adjusted in a plane transverse to the pipeline axis and passing through the pivot axis defined by the eye bolts. This enables the nozzle side stand-off distances (see our prior application for details) to be adjusted and equalized.

Figure 4:
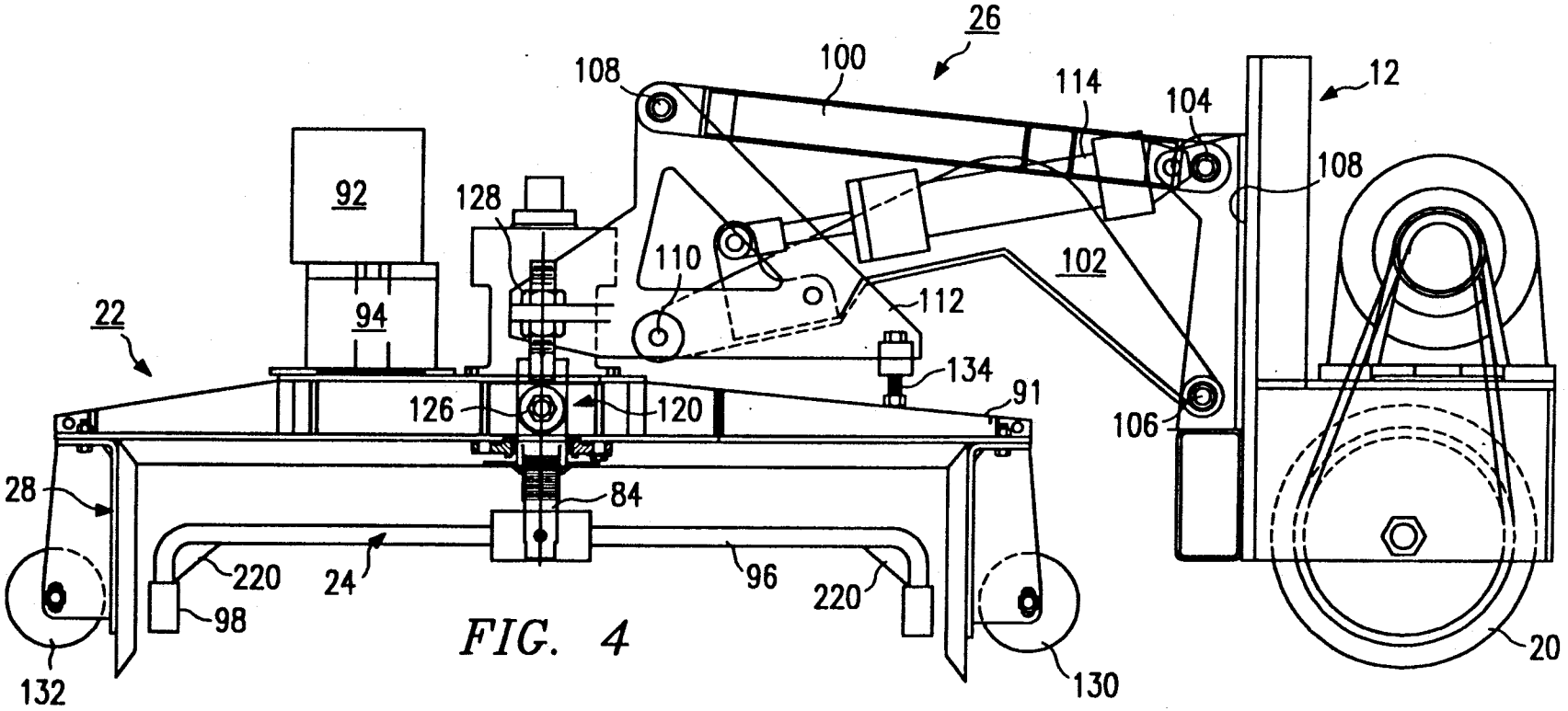
FIG. 4 is a side elevation view of a liquid jetting module and its suspension linkage.
Figure 5:
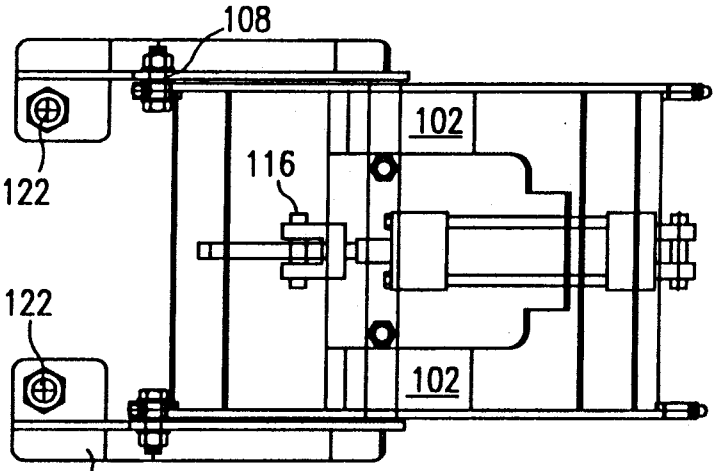
FIGS. 5, 6 and 7 are top, side and top views respectively of various components of the module suspension linkage.
Figure 7:
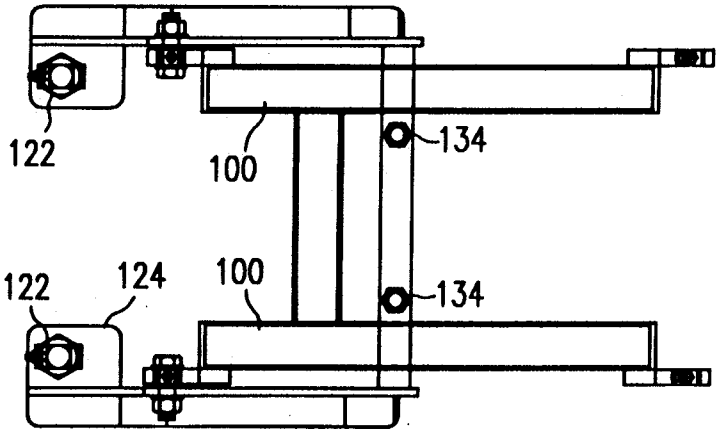
Figure 6:
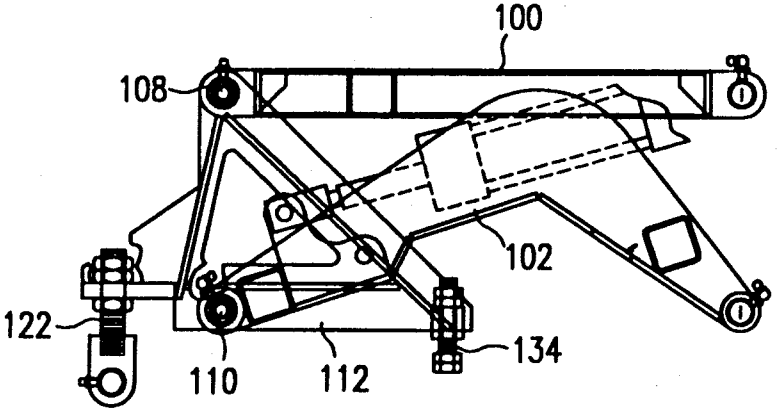

With the pivot arrangement just described, the module 22 is free to pitch about the above-noted pivot axis during operation. It will of course be noted that each module includes fore and aft guide and support wheels 130, 132 for supporting the module on the pipeline surface. When the module 22 is entirely free to pitch about the above-described pivot axis, both of these guide wheels 130, 132 will be in contact with the pipeline surface at all times. In cases where thick coatings are being removed, the forward guide wheel 130 can ride up on the coating while the other guide wheel 132 rides on the cleaned pipeline surface. The whole module pitches to and fro to the extent needed to accommodate the changes in coating thickness encountered as well as any other surface irregularities. This helps to ensure that the minimum standoff distances (e.g. about ½ inch) at the fore and aft nozzle passes remain substantially equal regardless of coating thickness. However, there are other situations, as where one is dealing with fairly thin coatings, where one wishes to keep the module parallel to the pipeline axis at all times and the rear guide wheel 132 clear of the pipeline surface as to prevent "tabbing" down of removed coating materials onto the pipeline surface by the action of this guide wheel. Therefore, in order to enable the module 22 to be effectively locked to prevent the pitching motion referred to, the end link 112 is provided with adjustable stops 134 in the form of studs which are rotated outwardly until they touch the top of the module frame as best seen in FIG. 4. When this has been done, only the forward guide wheel 130 contacts the pipeline surface.

Figure 13A:
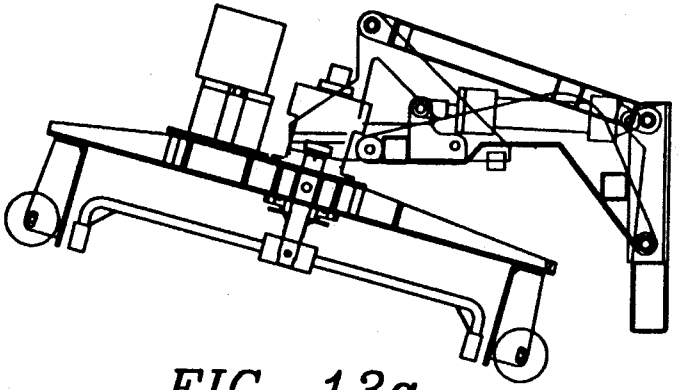
FIGS. 13A and 13B are side elevation views of a module and its suspension linkage showing the module at various pitch angles relative to the pipeline surface.
Figure 13B:
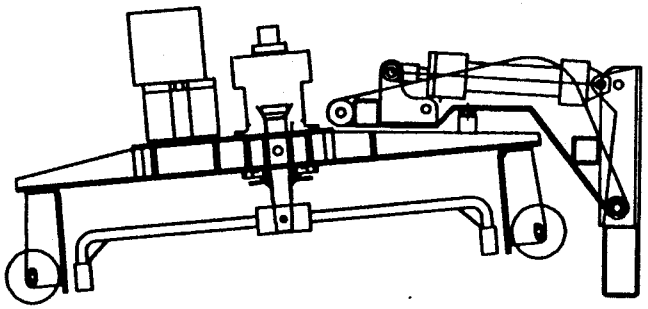

Another advantage associated with the module pivot axis arrangement noted is that any module 22 can be tilted forwardly or rearwardly (see FIGS. 13A and 13B for example) thereby to permit the swing arm nozzles to be inspected and repaired fairly readily.

It will be noted that the modules 22 are allocated rearwardly of the frame 12 of the machine in what might be termed a cantilever fashion and rearwardly of the fore and aft sets of drive wheels 18, 20. As noted previously, this is advantageous since the drive wheels cannot contact the cleaned pipeline surface and act to tamp down pieces of removed tape, adhesive and other debris onto the cleaned surface, reference being had to the earlier discussion regarding "tabbing" of the pipeline surface. When the rear module guide wheel 132 is held clear of the pipe surface by the adjustable stops 134 described previously, the tabbing problem should be substantially overcome.

Figure 9:
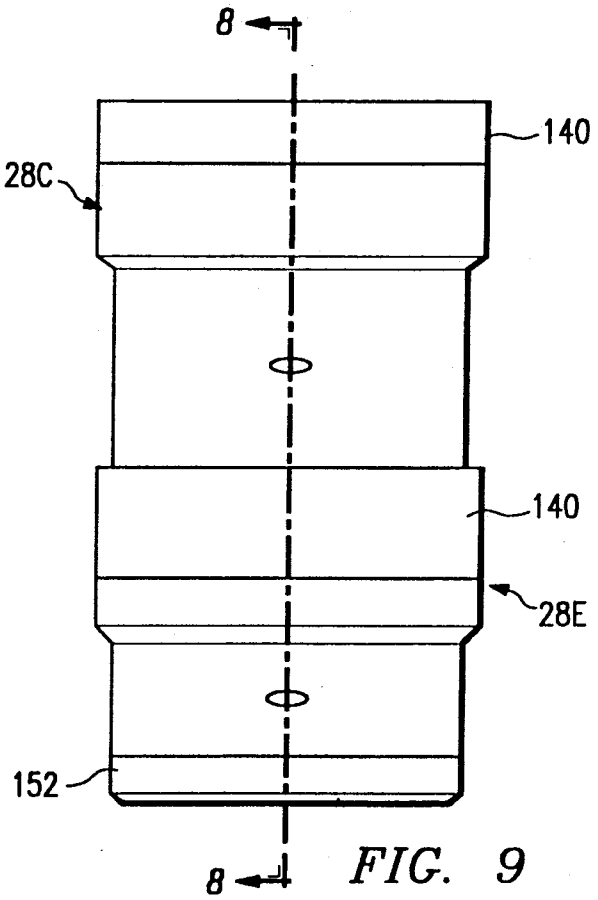
FIGS. 8 and 9 are section and side elevation views respectively of the overall shroud assembly with shrouds in their overlapping relationship, the swing arms being shown in phantom and the rest of the machine having been omitted.
Figure 8:
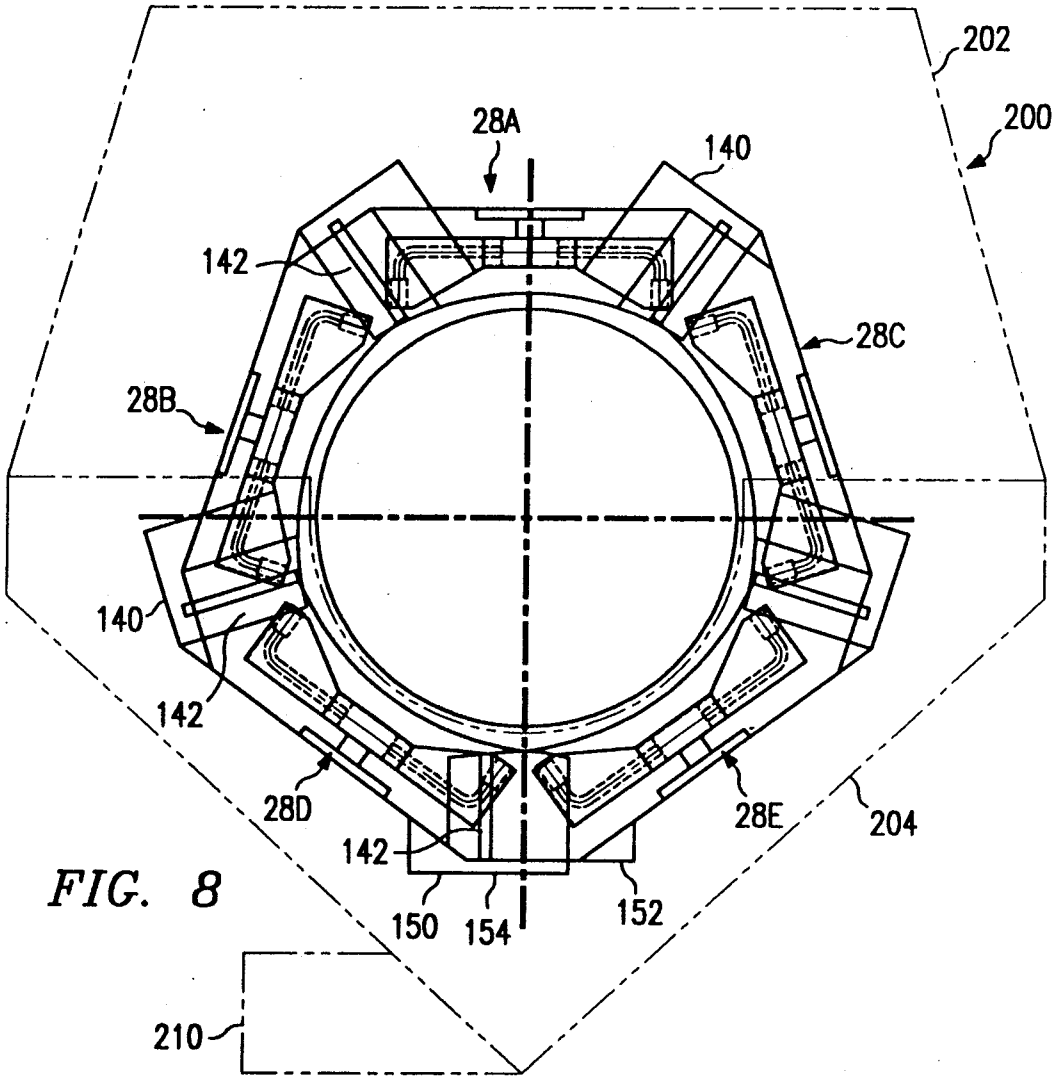

The need for protective shrouding was discussed previously and the shrouds 28 were noted briefly in connection with FIG. 1. With reference now to FIG. 8–12, the shroud assembly is shown in further detail. Each module 22 includes its own shroud rigidly fixed thereto and the shrouds of the adjacent modules are shown in FIGS. 1, 8 and 9 as defining an overlapping annular array fully enclosing the swing arm nozzle assemblies 24 all around the outside of the pipeline. A substantial degree of overlap between adjacent shrouds is provided by the angled shroud overlap wings 140. The overlapping relationship between adjacent shrouds allows for substantial radial motions of the modules and their shrouds relative to one another while at the same time the formation of substantial gaps between the shrouds is substantially avoided. Also, resilient sealing flaps 142 extend between the overlap portions of adjacent shrouds to further inhibit the escape of liquid and debris.

Figure 10:
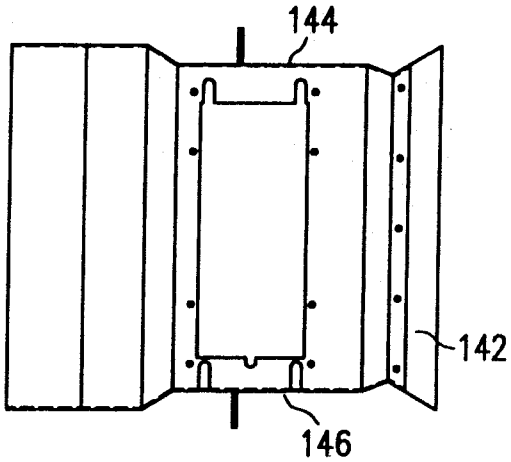
FIGS. 10, 11 and 12 are plan, end elevation and side elevation views of a shroud.
Figure 11:
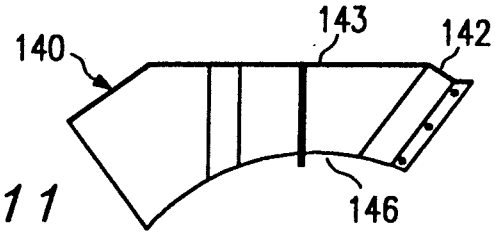
Figure 12:
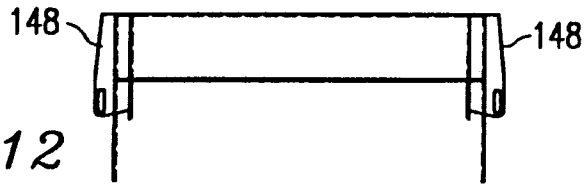

One shroud is shown in detail in FIG. 10–12. The shroud includes a flat top wall 143 which is bolted on to the frame 91 of the module (FIG. 4). The fore and aft end walls 144, 146 extend normal to top wall 143 and in use project inwardly into close proximity to the pipeline surface, the free edges of these walls being curved to match the pipeline surface contour. These end walls also include mounting brackets 148 for mounting the above-noted fore and aft module guide wheels 130, 132. The overlap wing 140 is angled relative to the intermediate section of the shroud and is of somewhat greater dimension in the lengthwise (travel) direction than the intermediate shroud section thereby to accommodate the next adjacent shroud without interference. The opposing side of the shroud is also angled inwardly and provided with a flared marginal portion to which is connected a resilient flap 142, the flap extending all along the free edge of that side of the shroud. When the shrouds are in their overlapping configuration, the flap 142 contacts the interior of the overlap wing 140 of the next adjacent shroud.

As will be seen from FIG. 8, the shrouds are somewhat different from one another depending on their locations. The uppermost shroud 28A, being overlapped on both sides by the overlap wings of shrouds 28B and 28C, does not have an overlap wing at all but is provided with a sealing flap 142 on both of its sides to effect sealing engagement with shrouds 28B and 28C. The lowermost shrouds 28D and 28E differ from shrouds 28B and C by the inclusion, at their lower ends, of an enlarged collector portion 150, 152 shaped to form a recess or sump when the shrouds are fitted together which receives the downwardly draining liquids and debris. A suitable opening 154 allows this material to escape into a suitable collector.

As noted previously, the several modules 22 and their suspension linkages 26 are each provided with a hydraulic actuator 114 to move the modules 22 including their shrouds 28 toward and away from the pipeline surface as when moving over certain obstacles that might be encountered on the pipeline surface. In order to prevent interference between adjacent shrouds 28 during such radial movement, time delays are incorporated into certain of the hydraulic lines to the actuators 114 to achieve the desired result. The preferred way of avoiding interference is to move the modules and attached shrouds inwardly in the time sequence in which they naturally move under gravity. For example, starting with all modules "out", the top (12 o'clock) module 28A will fall first, then the 10 and 2 o'clock modules 28B and C will fall simultaneously and finally the modules 28D and E at the 8 and 4 o'clock positions will rise simultaneously. An orifice is fitted into the flow circuit of the actuator for the 4 o'clock position, module 28E, so that it rises into position after the 8 o'clock module 28D is in place thereby avoiding interference. When "opening" up the modules, the above sequence is reversed.

As noted previously, many of the coatings that are to be removed from pipe contain hazardous materials, such as asbestos. Because of the degradation of the coating on the pipe being repaired, the asbestos is frequently in a friable condition, prone to ready disbursal of small fibers into the surrounding air space. Clearly, such contamination must be kept to a minimum.

The use of shrouds 28 will be useful in containing such contamination. However, the use of a shroud assembly 200, which completely envelops the modules 22 and frame 12, and allows for the maintenance of a relative vacuum or negative pressure within the interior of the shroud assembly, is believed to be the most efficient mechanism to contain such contamination.

Figure 15:
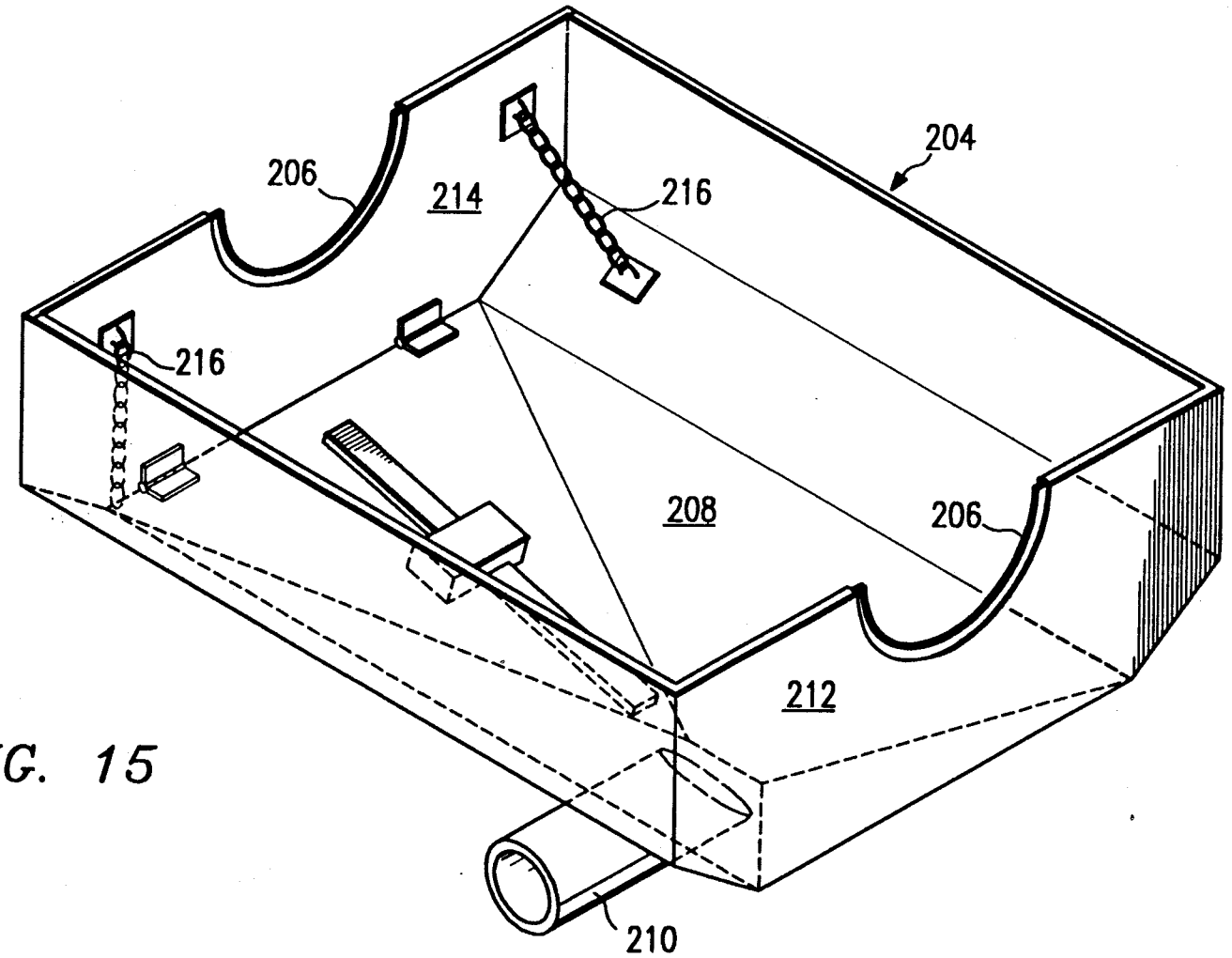
FIG. 15 is a perspective view of a collection pan for use when removing coatings having hazardous materials.

With references to FIGS. 8 and 15, the shroud assembly 200 can be seen in better detail. The shroud assembly 200 includes two sections, a top shroud 202 and a collection pan 204. By forming shroud assembly 200 in two pieces, the assembly can easily be installed about the modules 22 and frame 12 when on the pipeline. When installed, the top shroud 202 and collection pan 204 are secured together in a relatively airtight manner at their mating edges. Both the top shroud 202 and collection pan 204 have hemispherical openings at their ends on which are mounted flexible seal elements 206. When the top shroud 202 and collection pan 204 are secured together, the atmospherical openings align to form a cylindrical opening for passage of the pipe. The seals 206 provide a relative airtight seal to isolate the interior of the shroud assembly 200.

With reference specifically to FIG. 15, the details of the collection pan 204 can be better seen. The collection pan 204 has a doubly sloping bottom 208 which acts to concentrate all debris and contaminants at the lowest point of the bottom 208 at the opening of the suction fitting 210. A vibrator 220, acting through a bar 222 on the bottom 208, induces vibrations to assist in moving the debris downward to the suction fitting 210. The suction fitting 210 can be connected to a suction hose from a vacuum cleaning device which literally sucks out the debris and contaminants within the interior of the shroud assembly 200 as the pipe is being cleaned to safely dispose of the contaminants.

To make the installation of the collection pan 204 simpler, the end panels 212 and 214 on the pan 204 can be hinged to the bottom 208. When installed about the modules 22 and frame 12, the end panels 212 and 214 are held in place by chains 216. However, the chains 216 can be released and the end panels pivoted down about their hinges to facilitate either installation or removal of the pan.

During tests of the efficacy of an apparatus designed in accordance with teachings of the present invention on certain pipe coatings, specifically polyethylene tape, it was found that the particular cleaning action of the rotating swing arm nozzles 24 would tend to shred the tape and force the tape into the inner bend of the nozzles where it turns again along the axis of rotation of the nozzles to end in the nozzles themselves. The tap debris could be caught and wrapped about the arm in this inner bend to the point where it would affect the efficiency of the nozzles, possibly even prevent them from rotating as designed. A solution to this problem was found by installing paddles 220 across the inner bend on the nozzles 22 as seen in FIG. 4. The paddles shown cut across the inner bend at an angle of 45°, although it is clear that other angles may be utilized. Further, the inner edge of the paddle may be curved, rather than straight as shown, which would be expected to have even a more enhanced ability to deflect debris off the nozzle.

The manner of operation of the hydrocleaner described above will be readily apparent to those skilled in this art on review of this disclosure and the disclosures contained in our previous patent applications.

Numerous variations and modifications will readily occur to those skilled in this art upon reading the above description, and without departing from the spirit or scope of the invention. For definitions of the invention reference is to be had to the appended claims.

What is claimed is:

1. A method for the hydrocleaning of the exterior surface of a pipeline, said method comprising:

(a) positioning a plurality of liquid jet nozzles around a pipeline in spaced apart relation to one another and in preselected spaced relation to the exterior surface of said pipeline;

(b) supplying high pressure liquid to said plurality of liquid jet nozzles to cause emission of liquid jets from said plurality of liquid jet nozzles;

(c) causing said liquid jets to at least substantially simultaneously impinge on the exterior surface of said pipeline along prescribed paths located in an annular region extending around the circumference of said pipeline, each of said prescribed paths being in the form of continuous convolutions, wherein said prescribed paths together extend around the full circumferential extent of said pipeline; and (d) causing said annular region to move relative to said pipeline in the longitudinal direction of said pipeline, whereby cleaning of the exterior surface of said pipeline can be affected by a single longitudinal pass of said annular region.

2. A method as in claim 1 wherein each of said plurality of liquid jet nozzles is rotated about a respective associated rotation axis which is at least substantially normal to said exterior surface of said pipeline, with each of said liquid jets being emitted from a respective one of said plurality of liquid jet nozzles in radially spaced relation to the respective associated rotation axis.

3. A method as in claim 2 wherein each of said prescribed paths along which said liquid jets impinge on the exterior surface of said pipeline during the relative movement of said annular region is in the form of a series of closely spaced overlapping convolutions.

4. A method as in claim 3 wherein each of said plurality of liquid jet nozzles is caused to rotate about its associated rotation axis by a drive motor.

5. A method as in claim 1 wherein said plurality of liquid jet nozzles are positioned around the pipeline in circumferentially spaced apart relation to one another.

6. A method for cleaning the exterior surface of a pipe, said method comprising:

(a) positioning a plurality of liquid jet nozzles around the pipe in spaced apart relation to one another;

(b) supplying high pressure liquid to said plurality of liquid jet nozzles to cause emission of liquid jets from said plurality of liquid jet nozzles;

(c) causing said liquid jets to at least substantially simultaneously impinge on the exterior surface of the pipe along respective prescribed paths located in an annular region as said annular region moves relative to said pipe longitudinally thereof to effect cleaning of the exterior surface of the pipe; and (d) rotating each said liquid jet nozzle about an associated axis which is at least substantially normal to said exterior surface of said pipe, with each liquid jet being emitted from its respective liquid jet nozzle in radially spaced relation to the respective associated rotation axis such that said prescribed paths are in the form of continuous convolutions, with said prescribed paths together extending around the full circumferential extent of said pipe, whereby the exterior surface of said pipe can be cleaned by a single longitudinal pass of said annular region.

7. A method as in claim 6 wherein each of said prescribed paths, along which a liquid jet impinges on the exterior surface of the pipe during the relative movement of the annular region and the pipe, is in the form of a series of closely spaced overlapping convolutions.

8. A method as in claim 7 wherein each said liquid jet nozzle is caused to rotate about its associated rotation axis by a drive motor connected to the respective liquid jet nozzle.

9. A method according to claim 6 wherein said plurality of liquid jet nozzles are positioned around the pipe in circumferentially spaced apart relation to one another.

10. A method for cleaning an exterior surface of a pipe having a longitudinal axis, said method comprising:

positioning a plurality of liquid jet nozzles around said pipe in spaced apart relation to one another, each said liquid jet nozzle being directed toward the exterior surface of the pipe, moving each said liquid jet nozzle relative to the exterior surface of the pipe to produce a liquid jet that traces a respective path in the form of a continuous convolution on the exterior surface of the pipe whereby the thus traced liquid jet path of each liquid jet nozzle overlaps a thus traced liquid jet path of at least one other liquid jet nozzle to provide cleaning of the entire circumference of said pipe;

supplying pressurized liquid to said plurality of liquid jet nozzles, whereby said plurality of liquid jet nozzles at least substantially simultaneously emit jets of pressurized liquid toward said exterior surface of said pipe; and providing relative longitudinal movement between said plurality of liquid jet nozzles and said pipe whereby said liquid jets effect cleaning about the entire circumference of said pipe and whereby the exterior surface of said pipe can be cleaned by a single longitudinal pass between said plurality of liquid jet nozzles and the length of the pipe to be cleaned.

11. A method according to claim 10 wherein each of said plurality of liquid jet nozzles is directed toward said pipe in a direction at least substantially perpendicular to the longitudinal axis of said pipe.

12. A method according to claim 10 wherein each of said plurality of liquid jet nozzles is rotated about a respective associated rotation axis which is at least substantially perpendicular to the longitudinal axis of said pipe.

13. A method according to claim 11, wherein each of said plurality of liquid jet nozzles is rotated about a respective associated rotation axis which is at least substantially perpendicular to the longitudinal axis of said pipe.

14. A method according to claim 10 wherein each said liquid jet is emitted from its respective liquid jet nozzle in radially spaced relation to the respective rotation axis.

15. A method according to claim 10 wherein each of said plurality of liquid jet nozzles is rotated about a respective rotation axis which is at least substantially perpendicular to the longitudinal axis of said pipe, and wherein each said liquid jet is emitted from its respective liquid jet nozzle in radially spaced relation to the respective rotation axis.

16. A method according to claim 15 wherein each of said plurality of liquid jet nozzles is directed toward said pipe in a direction at least substantially perpendicular to the longitudinal axis of said pipe.

17. A method according to claim 15 wherein adjacent convoluted paths overlap each other.

18. A method according to claim 17 wherein each of said plurality of liquid jet nozzles is directed toward said pipe in a direction at least substantially perpendicular to the longitudinal axis of said pipe.

19. A method according to claim 10 wherein said plurality of liquid jet nozzles are positioned around the pipe in circumferentially spaced apart relation to one another.

20. A method for cleaning the exterior surface of a pipe, said method comprising:

(a) positioning a plurality of liquid jet nozzles around a pipe in spaced apart relation to one another;

(b) supplying high pressure liquid to said plurality of liquid jet nozzles to cause emission of liquid jets from said plurality of liquid jet nozzles;

(c) causing said liquid jets to at least substantially simultaneously impinge on the exterior surface of said pipe along prescribed paths located in an annular region, said prescribed paths being in the form of continuous convolutions, with said prescribed paths together extending around the full circumferential extent of said pipe; and (d) causing said annular region to move relative to said pipe in the longitudinal direction of said pipe, whereby cleaning of the full circumferential extent of the exterior surface of said pipe can be effected during a single pass of said annular region.

21. A method as in claim 20 wherein each of said plurality of liquid jet nozzles is rotated about an associated rotation axis which is at least substantially normal to said exterior surface of said pipe, with each of said liquid jets being emitted from a respective one of said plurality of liquid jet nozzles in radially spaced relation to the respective associated rotation axis.

22. A method as in claim 21 wherein each of said prescribed paths along which said liquid jets impinge on the exterior surface of said pipe during the relative movement of said annular region is in the form of a series of closely spaced overlapping convolutions.

23. A method as in claim 22 wherein each of said plurality of liquid jet nozzles is caused to rotate about its associated rotation axis by a drive motor.

24. A method according to claim 20 wherein said plurality of liquid jet nozzles are positioned around the pipe in circumferentially spaced apart relation to one another.

* * * * *

UNITED STATES PATENT AND TRADEMARK OFFICE

CERTIFICATE OF CORRECTION

PATENT NO. : 5,226,973

DATED : July 13, 1993

INVENTOR(S) : Gordon R. Chapman et al

It is certified that error appears in the above-identified patent and that said Letters Patent is hereby corrected as shown below:

Column 13, line 36, change "affected" to --effected--.

Signed and Sealed this

First Day of March, 1994

Bruce Lehman

*Attest:*

BRUCE LEHMAN

*Attesting Officer*

*Commissioner of Patents and Trademarks*